US012698905B2

(12) United States Patent
Auer et al.

(10) Patent No.: US 12,698,905 B2
(45) Date of Patent: Aug. 4, 2026

(54) EDGE TO EDGE COOKTOP GASKET

(71) Applicant: WHIRLPOOL CORPORATION, Benton Harbor, MI (US)

(72) Inventors: Alexander Auer, Benton Harbor, MI (US); Satish Janardhan Kathar, Aurangabad (IN); Akhil Haribhau Wankhede, Chandrapur (IN); Ajit Janardan Manohar, Maharashtra (IN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 402 days.

(21) Appl. No.: 18/225,415

(22) Filed: Jul. 24, 2023

(65) Prior Publication Data

US 2025/0035317 A1 Jan. 30, 2025

(51) Int. Cl.
*F24C 15/10* (2006.01)

(52) U.S. Cl.
CPC ..... *F24C 15/10* (2013.01)

(58) Field of Classification Search
CPC ..... F24C 15/10
See application file for complete search history.

(56) References Cited

U.S. PATENT DOCUMENTS 5,014,464 A * 5/1991 Dupuy ..... B60J 10/16 49/440
5,185,047 A * 2/1993 Ray ..... F24C 15/108 156/244.11
5,785,047 A * 7/1998 Bird ..... F24C 15/108 219/452.12
5,968,219 A * 10/1999 Gille ..... C03B 23/023 264/339
7,281,715 B2 10/2007 Boswell
10,184,668 B2 1/2019 Sanquist
10,376,098 B2 8/2019 Chun et al.
11,045,045 B2 6/2021 Chun et al.
2015/0201465 A1* 7/2015 Adelmann ..... F24C 15/08 219/461.1
2021/0259464 A1 8/2021 True et al.
2022/0003424 A1 1/2022 Hatchett

FOREIGN PATENT DOCUMENTS

EP 3995745 5/2022
JP 2006105555 4/2006

OTHER PUBLICATIONS

Munaco Sealing Solutions, "Co-Extruded Seals," https://www.munacosealing.com/products/rubber-silicone-extrusions/co-extruded-seals (Jun. 2023).
GTeek, "Edge Trim Profile with TR 2008 Self Grip Seal," https://www.gteek.com/edge-trim-profile-with-tr-2008-self-grip-seal?search=tr%202008 (Jun. 2023).

* cited by examiner

*Primary Examiner* — Michael G Hoang
*Assistant Examiner* — Logan P Jones
(74) *Attorney, Agent, or Firm* — PRICE HENEVELD LLP

(57) ABSTRACT

A gasket for a cooking appliance is positioned between a rear upswept section of the appliance and the cooktop surface. The gasket has a rigid section that is received in a gasket groove in the upswept section of the appliance and a flexible section that contacts the top surface of the cooktop surface. The gasket has a compressible gap that allows the gasket to seal to different length gaps between the cooktop surface and the gasket groove.

20 Claims, 7 Drawing Sheets

EDGE TO EDGE COOKTOP GASKET

BACKGROUND OF THE DISCLOSURE

The present disclosure generally relates to a cooking appliance and, more specifically, to a gasket that provides a seal between the cooktop surface and the upswept portion of the cooking appliance. Water, cleaning products, fluids, food, and other contaminants can potentially enter the interface between the rear edge of the cooktop surface and the upswept section of the cooking appliance. Those contaminants can cause damage to the internal components of the appliance and to the cooktop surface. Thus, a gasket that provides a seal that can accommodate different gaps between the cooktop surface and the appliance would potentially reduce entry of contaminants at that interface.

SUMMARY OF THE DISCLOSURE

According to one aspect of the present disclosure is a gasket for a cooktop unit having an upswept section extending adjacent to the rear of the cooktop unit. The cooktop unit has cooktop housing has a front surface, rear surface, and two side surfaces. A gasket groove is located in the upswept section. The gasket is single piece gasket having a rigid section and a flexible section, the rigid section including a projection that is received in the gasket groove, and the flexible section including a curved section and a sealing section that contacts a cooktop surface coupled to the cooktop housing.

According to another aspect of the present disclosure is a cooktop unit having an upswept section extending adjacent to the rear of the cooktop unit. The cooktop unit has a cooktop surface coupled to the cooktop unit. A gasket groove is located in the upswept section, the gasket groove extending adjacent to the entire length of the cooktop surface. A gasket is a single piece gasket having a rigid section and a flexible section, the rigid section including a projection that is received in the gasket groove, and the flexible section including a curved section and a sealing section that contacts the cooktop surface.

According to yet another aspect of the present disclosure is an appliance having a cooktop surface that extends over each lateral side of the appliance. A gasket groove is located in a rear portion of the appliance adjacent to the cooktop surface. A gasket has a rigid section and a flexible section, the rigid section including a projection that is received in the gasket groove, and the flexible section including a curved section and a sealing section that contacts the cooktop surface.

These and other features, advantages, and objects of the present disclosure will be further understood and appreciated by those skilled in the art by reference to the following specification, claims, and appended drawings.

Figure 1:
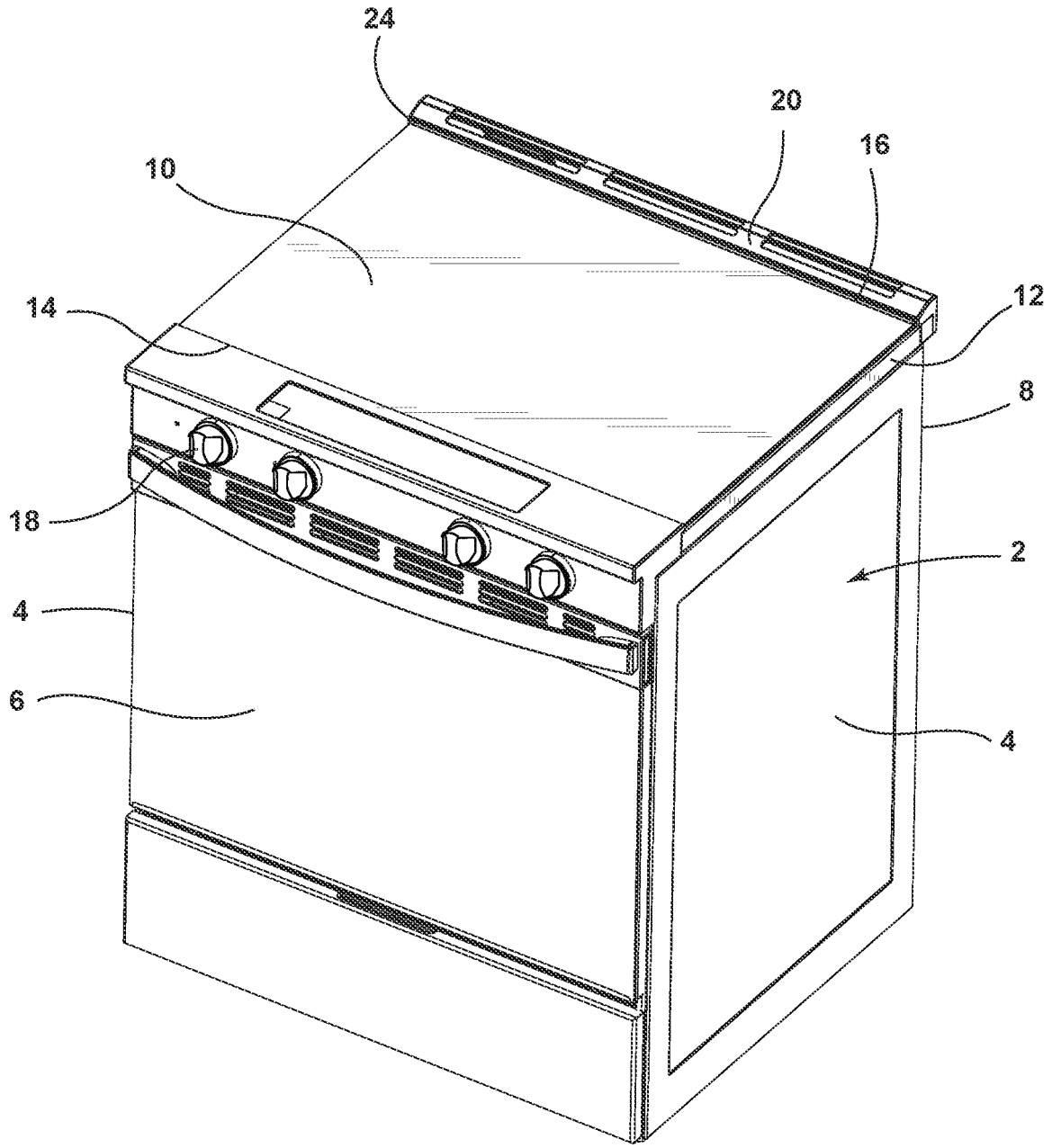
FIG. 1 is a perspective view of an appliance with front controls and an edge to edge cooktop unit.

The components in the figures are not necessarily to scale, emphasis instead being placed upon illustrating the principles described herein.

DETAILED DESCRIPTION

The present illustrated embodiments reside primarily in combinations of method steps and apparatus components related to a gasket for a cooking appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 2:
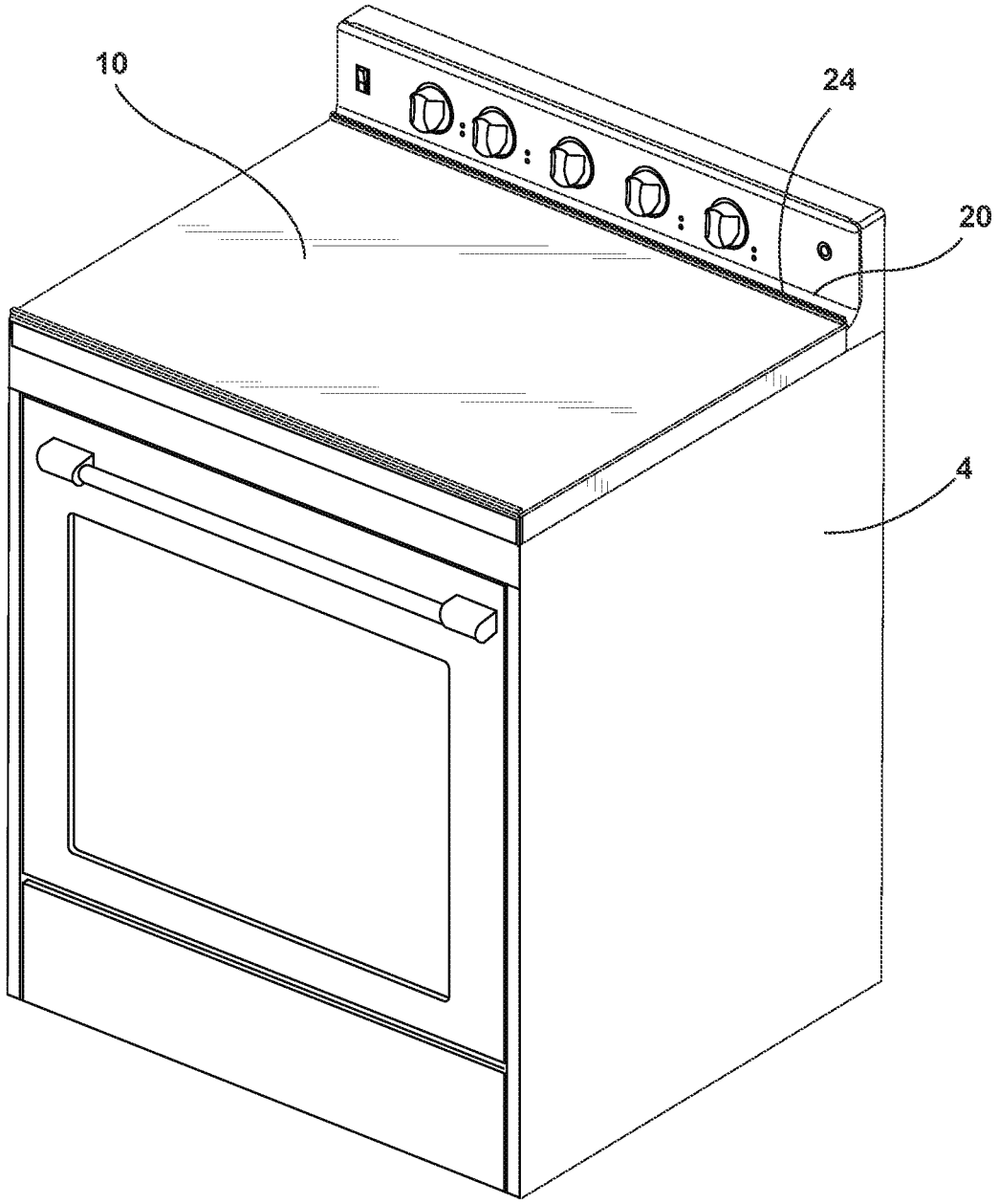
FIG. 2 is a perspective view of an appliance with rear controls and an edge to edge cooktop unit.

Referring to FIG. 1, reference numeral 2 generally designates a cooking appliance such as an oven. The cooking appliance 2 has a front surface 6, a back surface 8, and side surfaces 4. A cooktop surface 10 is coupled to the cooking appliance 2. The cooktop surface 10 has side edges 12, a front edge 14, a rear edge 16, and a top surface 30. Control knobs 18 can be used to activate heating areas on the cooking appliance 2. The control knobs 18 can be located on the front (as shown in FIG. 1) or rear (as shown in FIG. 2) of the cooking appliance 2.

Figure 3:
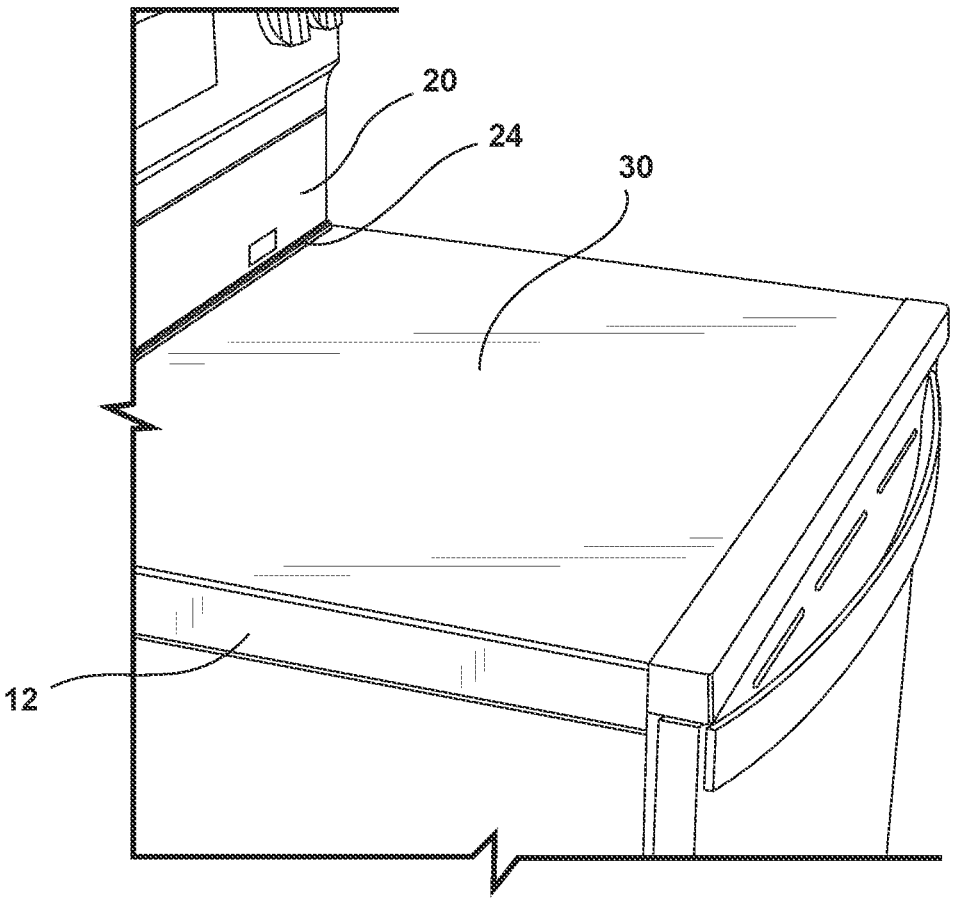
FIG. 3 is a partial top perspective view of an appliance with an edge to edge cooktop unit.
Figure 4:
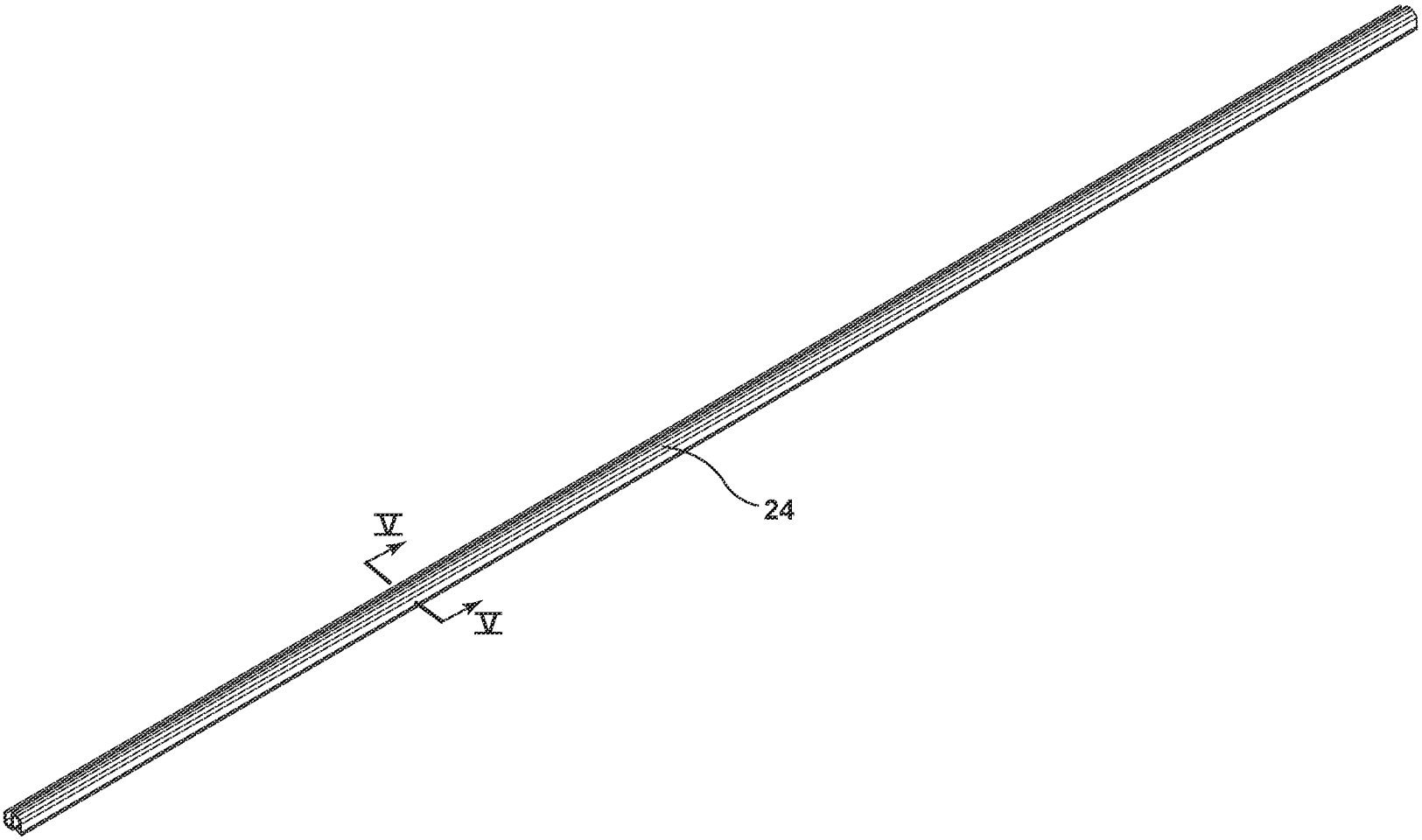
FIG. 4 is a perspective view of a cooktop unit gasket.
Figure 6:
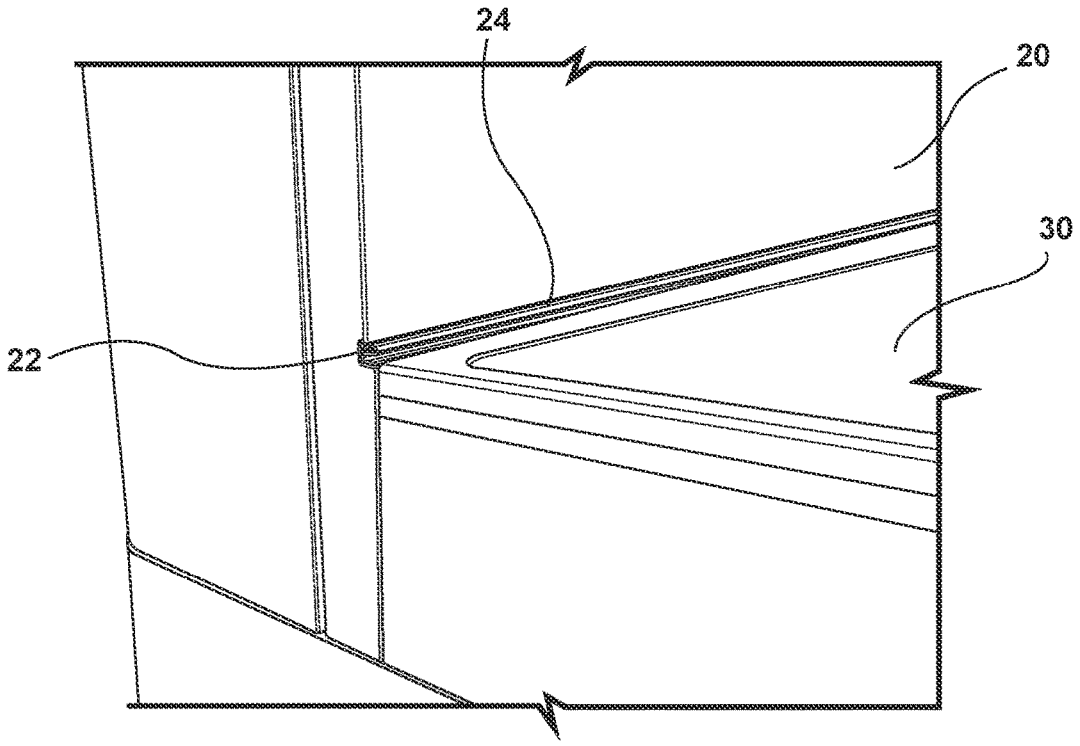
FIG. 6 is a partial perspective view of the gasket shown in FIG. 4 installed in an appliance.

The cooktop surface 10 is illustrated as extending to the side edges 4 of the cooking appliance 2. The side edges 12 of the cooktop surface 10 extend to and/or over the side edges 4 of the cooking appliance 2 creating an edge to edge cooktop surface 10. The top surface 30 of the cooktop surface 10 can be entirely flat, as shown in FIGS. 1-3, or can include a tiered surface, as shown in FIG. 6.

In the illustrated embodiments, the cooking appliance 2 includes an upswept section 20 that is adjacent to the rear edge 16 of the cooktop surface 10. The upswept section 20 includes a gasket groove 22, as illustrated in FIG. 6. The gasket groove 22 extends along the entire back side 16 of the cooktop surface 10. The gasket groove 22 has a cross-sectional profile designed to receive a portion of the gasket 24.

The gasket 24 includes a rigid section 26 and a flexible section 28. The gasket 24 can be formed by co-extrusion of a rigid material and a flexible material. Given that the gasket 24 is used on a cooking appliance 2 adjacent to and in contact with a cooking surface 10, the rigid material and the flexible material should be able to withstand high temperatures, especially the flexible material as the flexible section 28 will contact the top surface 30 of the cooktop surface 10.

For example, the flexible material should be able to withstand a temperature of at least 80° C. In the illustrated embodiment, the rigid material is a thermoplastic elastomer with a first shore hardness, while the flexible material is also a thermoplastic elastomer with a second shore hardness that is lower than the first shore hardness.

The rigid section 26 of gasket 24 has a tab section 31 that is received within the gasket groove 22, as illustrated in FIG. 6. The tab section 31 can include an upper rounded section 52 and a lower section 50 with a shoulder 58. The upper rounded section 52 permits the rigid section 26 to be inserted into the gasket groove 22 and rotated into place. The gasket groove 22 has a surface that contacts the shoulder 58 of the tab section 31 to retain the gasket 24 into the gasket groove 22.

The rigid section 26 also includes sections 60 and 54 that will be generally parallel to the top surface 30 of the cooktop surface 10 when the gasket 24 is installed into the gasket groove 22.

Figure 5:
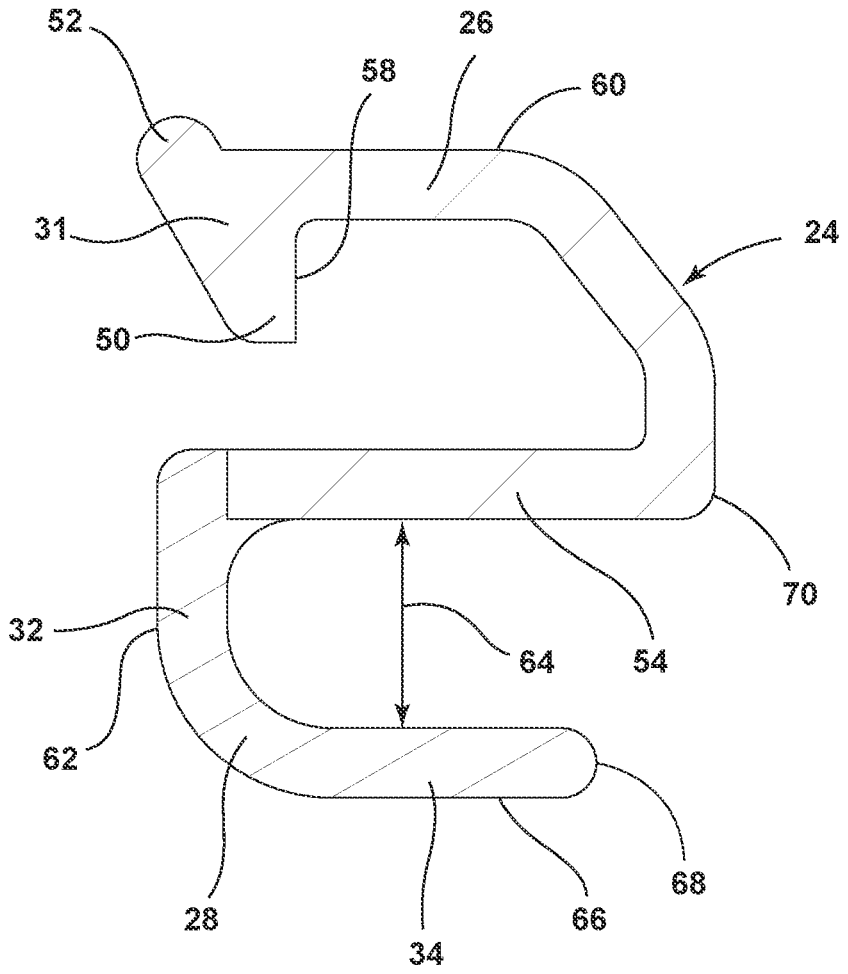
FIG. 5 is a rotated cross-sectional view of the gasket shown in FIG. 4, along line V-V.
Figure 7:
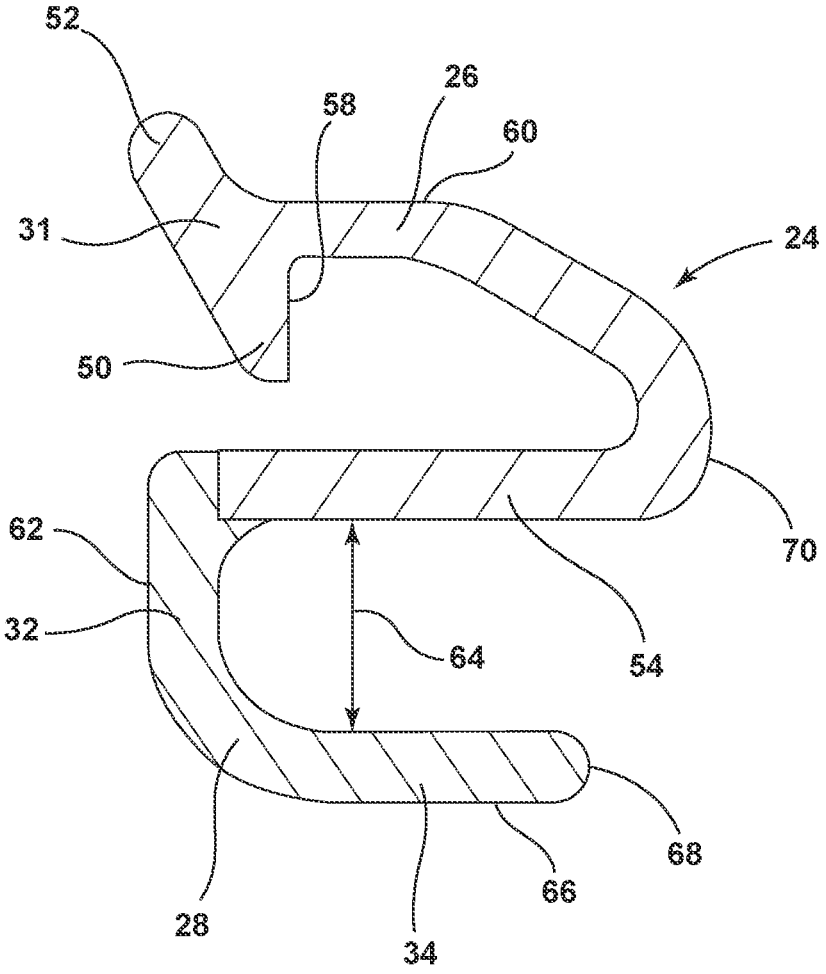
FIG. 7 is a cross-sectional view of another embodiment of a cooktop unit gasket.

The flexible section 28 includes a side section 62 and a bottom section 34. The lower surface 66 of the bottom section 34 contacts the top surface 30 of the cooktop surface 10. The length of the side section 62 can be increased or decreased to vary the gap 64 between section 54 of the rigid section 26 and the bottom section 34 of the flexible section 32. In addition, the flexible section 32 can compress against the upswept section 20 and/or the top surface 30 of the cooktop surface 10 to provide a seal between the upswept section 20 and the cooktop surface 10 despite a variation in gaps between the upswept section 20 and the top surface 30. The gap 64 illustrated in FIGS. 5 and 7 shows the gasket 24 before the compression of the bottom section 34 toward section 54. Depending upon the spacing of the cooktop surface 10 to the gasket groove 22, the bottom section 34 could contact section 54 or can be spaced away from section 54.

The front terminal end 68 of the bottom section 34 is illustrated as not extending to the front edge 70 of the rigid section 26. This permits the front edge 70 of the rigid section 26 to protect the front terminal end 68 of the flexible section 28 from damage by objects on cooktop surface 10.

The gasket 24 has a generally reversed S-shape cross-sectional profile when installed in the gasket groove 22. The gasket 24 shown in FIG. 5 and the gasket 24 shown in FIG. 7 have similar reversed S-shaped cross-sectional profiles, however, the shape of the tab section 31 and the shape of the rigid section 26 are slightly altered.

The invention disclosed herein is further summarized in the following paragraphs and is further characterized by combinations of any and all of the various aspects described therein.

According to another aspect of the present disclosure, a gasket for a cooktop unit having an upswept section extending adjacent to the rear of the cooktop unit. The cooktop unit having a cooktop housing having a front surface, rear surface, and two side surfaces. A gasket groove is located in said upswept section. The gasket is a single piece gasket having a rigid section and a flexible section, said rigid section including a projection that is received in said gasket groove, and said flexible section including a curved section and a sealing section that contacts a cooktop surface coupled to said cooktop housing.

According to another aspect, wherein said rigid section includes a section that is generally parallel to said cooktop surface.

According to another aspect, wherein said gasket is co-extruded.

According to another aspect, wherein said rigid section includes a curved surface.

According to another aspect, wherein said cooktop surface extends over the side surface of the cooktop housing.

According to another aspect, wherein said rigid material is a thermoplastic elastomer.

According to another aspect, wherein said flexible material is a thermoplastic elastomer.

According to another aspect, wherein said gasket has a generally reversed S-shaped cross-sectional profile.

According to another aspect, a cooktop unit having an upswept section extending adjacent to the rear of the cooktop unit. The cooktop unit having a cooktop surface coupled to said cooktop unit. A gasket groove located in said upswept section, said gasket groove extending adjacent to the entire length of said cooktop surface. The gasket is a single piece gasket having a rigid section and a flexible section, said rigid section including a projection that is received in said gasket groove, and said flexible section including a curved section and a sealing section that contacts said cooktop surface.

According to another aspect, wherein said rigid section includes a section of said gasket that is generally parallel to said cooktop surface.

According to another aspect, wherein said gasket is co-extruded.

According to another aspect, wherein said rigid section includes a curved surface.

According to another aspect, wherein said rigid material is a thermoplastic elastomer.

According to another aspect, wherein said flexible material is a thermoplastic elastomer.

According to another aspect, wherein said gasket has a generally reversed S-shaped cross-sectional profile.

According to yet another aspect, an appliance having a cooktop surface that extends over each lateral side of the appliance. A gasket groove is located in a rear portion of said appliance adjacent to said cooktop surface. The gasket having a rigid section and a flexible section, said rigid section including a projection that is received in said gasket groove, and said flexible section including a curved section and a sealing section that contacts said cooktop surface.

According to another aspect, wherein said rigid section includes a section that is generally parallel to said cooktop surface.

According to another aspect, wherein said gasket is co-extruded.

According to another aspect, wherein said rigid section includes a curved surface.

According to another aspect, wherein said gasket has a generally reversed S-shaped cross-sectional profile.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A gasket for a cooktop unit having an upswept section extending adjacent to the rear of the cooktop unit, comprising:

a cooktop housing having a front surface, rear surface, and two side surfaces;

a gasket groove located in said upswept section; and a single piece gasket having a rigid section and a flexible section, said rigid section including a projection that is received in said gasket groove, said projection including an upper rounded section and a lower section with a shoulder, wherein said upper rounded section permits said rigid section to be inserted into said gasket groove and rotated into place, and wherein said gasket groove has a surface that contacts said shoulder to retain said gasket in said gasket groove, and said flexible section including a curved section and a sealing section that contacts a cooktop surface coupled to said cooktop housing, wherein said flexible section includes a side section and a bottom section, and wherein said flexible section is configured to compress against said upswept section and said cooktop surface to provide a seal between said upswept section and said cooktop surface.

2. The gasket for a cooktop unit of claim 1, wherein said bottom section has a front terminal end that does not extend to a front edge of said rigid section.

3. The gasket for a cooktop unit of claim 1, wherein said gasket is co-extruded.

4. The gasket for a cooktop unit of claim 1, wherein said rigid section includes a curved surface.

5. The gasket for a cooktop unit of claim 1, wherein said cooktop surface extends over the side surface of the cooktop housing.

6. The gasket for a cooktop unit of claim 1, wherein said rigid material is a thermoplastic elastomer with a first shore hardness.

7. The gasket for a cooktop unit of claim 6, wherein said flexible material is a thermoplastic elastomer with a second shore hardness that is lower than said first shore hardness.

8. The gasket for a cooktop unit of claim 1, wherein said gasket has a generally reversed S-shaped cross-sectional profile.

9. A cooktop unit having an upswept section extending adjacent to the rear of the cooktop unit, comprising:

a cooktop surface coupled to said cooktop unit;

a gasket groove located in said upswept section, said gasket groove extending adjacent to the entire length of said cooktop surface; and a single piece gasket having a rigid section and a flexible section, said rigid section including a projection that is received in said gasket groove, said projection including an upper rounded section and a lower section with a shoulder, wherein said upper rounded section permits said rigid section to be inserted into said gasket groove and rotated into place, and wherein said gasket groove has a surface that contacts said shoulder to retain said gasket in said gasket groove, and said flexible section including a curved section and a sealing section that contacts a cooktop surface coupled to said cooktop housing, wherein said flexible section includes a side section and a bottom section, and wherein said flexible section is configured to compress against said upswept section and said cooktop surface to provide a seal between said upswept section and said cooktop surface.

10. The cooktop unit of claim 9, wherein said bottom section has a front terminal end that does not extend to a front edge of said rigid section.

11. The cooktop unit of claim 9, wherein said gasket is co-extruded.

12. The cooktop unit of claim 9, wherein said rigid section includes a curved surface.

13. The cooktop unit of claim 9, wherein said rigid material is a thermoplastic elastomer with a first shore hardness.

14. The cooktop unit of claim 13, wherein said flexible material is a thermoplastic elastomer with a second shore hardness that is lower than said first shore hardness.

15. The cooktop unit of claim 9, wherein said gasket has a generally reversed S-shaped cross-sectional profile.

16. An appliance having a cooktop surface that extends over each lateral side of the appliance, and an upswept section extending adjacent to the rear of the cooktop unit:

a gasket groove located in a rear portion of said appliance adjacent to said cooktop surface; and a gasket having a rigid section and a flexible section, said rigid section including a projection that is received in said gasket groove, said projection including an upper rounded section and a lower section with a shoulder, wherein said upper rounded section permits said rigid section to be inserted into said gasket groove and rotated into place, and wherein said gasket groove has a surface that contact said shoulder to retain said gasket in said gasket groove, and said flexible section including a curved section and a sealing section that contacts a cooktop surface coupled to said cooktop housing, wherein said flexible section includes a side section and a bottom section, and wherein said flexible section is configured to compress against said upswept section and said cooktop surface to provide a seal between said upswept section and said cooktop surface.

17. The appliance of claim 16, wherein said bottom section has a front terminal end that does not extend to a front edge of said rigid section.

18. The appliance of claim 16, wherein said gasket is co-extruded.

19. The appliance of claim 16, wherein said rigid section includes a curved surface.

20. The appliance of claim 16, wherein said gasket has a generally reversed S-shaped cross-sectional profile.

* * * * *